US011545293B1

(12) United States Patent
LeBlanc et al.

(10) Patent No.: US 11,545,293 B1
(45) Date of Patent: Jan. 3, 2023

(54) BOBBIN FOR EDGE-MOUNTED MAGNETIC CORE

(71) Applicant: UNIVERSAL LIGHTING TECHNOLOGIES, INC., Madison, AL (US)

(72) Inventors: Mike LeBlanc, Huntsville, AL (US); Donald Folker, Madison, AL (US); Dane Sutherland, Madison, AL (US); Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 17/506,169

(22) Filed: Oct. 20, 2021

Related U.S. Application Data

(62) Division of application No. 16/212,384, filed on Dec. 6, 2018, now Pat. No. 11,201,006.

(60) Provisional application No. 62/598,498, filed on Dec. 14, 2017.

(51) Int. Cl.

| | |
|---|---|
| ***H01F 27/26*** | (2006.01) |
| ***H01F 27/30*** | (2006.01) |
| ***H01F 27/28*** | (2006.01) |
| ***H01F 41/06*** | (2016.01) |
| *H01F 27/29* | (2006.01) |

(52) U.S. Cl.
CPC ..... *H01F 27/266* (2013.01); *H01F 27/2823* (2013.01); *H01F 27/30* (2013.01); *H01F 41/06* (2013.01); *H01F 27/26* (2013.01); *H01F 27/28* (2013.01); *H01F 27/292* (2013.01); *H01F 27/306* (2013.01)

(58) Field of Classification Search
CPC .... H01F 27/266; H01F 27/2823; H01F 27/30; H01F 41/06; H01F 27/26; H01F 27/28; H01F 27/292; H01F 27/306; H01F 27/00–40
See application file for complete search history.

(56) References Cited

U.S. PATENT DOCUMENTS

| | | | | |
|---|---|---|---|---|
| 5,870,011 | A | 2/1999 | Mori et al. | |
| 2012/0223795 | A1 * | 9/2012 | Hester | H01F 27/324 336/90 |
| 2013/0321114 | A1 | 12/2013 | Lin et al. | |

(Continued)

FOREIGN PATENT DOCUMENTS

JP S6023938 Y2 * 7/1985

*Primary Examiner* — Tuyen T Nguyen
(74) *Attorney, Agent, or Firm* — Patterson Intellectual Property Law, P.C.

(57) ABSTRACT

An edge mount magnetic component includes a bobbin and two E-core halves. The bobbin is configured to receive the two E-core halves when body portions of the two E-core halves are positioned vertically. The bobbin includes a first outer flange, a second outer flange, and a passageway spanning therebetween. The bobbin further includes first, second, third, and fourth pin supports. The first and second pin supports are connected to an outer surface of the first end flange and are spaced apart by at least a width of the passageway. The third and fourth pin supports are connected to an outer surface of the second end flange and are spaced apart by at least the width of the passageway. The bobbin further includes slots for routing a winding to a pin and includes walls to ensure the winding is electrically separated from the E-core halves.

9 Claims, 10 Drawing Sheets

(56) References Cited

U.S. PATENT DOCUMENTS

| | | | |
|---|---|---|---|
| 2014/0160644 | A1 | 6/2014 | Nam et al. |
| 2015/0137928 | A1 | 5/2015 | Wakibayashi et al. |

* cited by examiner

BOBBIN FOR EDGE-MOUNTED MAGNETIC CORE

CROSS-REFERENCE TO RELATED APPLICATION

This application is a divisional application of U.S. patent application Ser. No. 16/212,384, filed on Dec. 6, 2018, which claims the benefit under 35 USC. § 119(e) of U.S. Provisional Application No. 62/598,498, filed Dec. 14, 2017, entitled "Bobbin for Edge Mounted Magnetic," which are hereby incorporated by reference in their entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present disclosure relates generally to magnetic components that include a bobbin that supports a magnetic core and that supports a coil wound around at least a portion of the magnetic core. More particularly, the present disclosure is directed to a bobbin that supports a magnetic core having two E-core halves wherein a coil is wound around portions of the middle legs of the two E-core halves.

BACKGROUND

Bobbins supporting first and second E-core halves are common in electrical and electronic circuits. Each E-core half includes a body portion, a middle leg, a first outer leg and a second outer leg. The legs extend perpendicularly from the body portion with the outer legs extending from end portions of the body portion and with the middle leg positioned between the outer legs. A bobbin includes a central passageway. A coil is wound around the outside of at least a portion of the central passageway between at least a first outer flange and a second outer flange.

The central passageway of the bobbin receives at least a portion the middle leg of each E-core half. The end surfaces of the two middle legs may abut within the central passageway or may be spaced apart by a small distance for form an air gap in the magnetic core formed by the two E-core halves. When the middle legs are positioned within the central passageway of the bobbin, the outer legs are positioned around outer surfaces of the bobbin with respective end surfaces of the outer legs of one of the first E-core half abutting respective end surfaces of the outer legs of the second E-core half. The first and second outer legs of each E-core half are spaced apart from the middle leg of the E-core half to accommodate the flanges at each end of the central passageway.

The two E-core halves form a common inner magnetic path through the middle legs of the two E-cores. At the body portion of the first E-core half, the common magnetic path through the middle leg of the first E-core half divides into a first magnetic path and a second magnetic path. The first magnetic path extends to and through the first outer leg of the first E-core half, through the first outer leg of the second E-core half and returns through the body portion of the second E-core half to the middle leg of the second E-core half. The second magnetic path extends to and through the second outer leg of the first E-core half, through the second outer leg of the second E-core half and returns through the body portion of the second E-core half to the middle leg of the second E-core half. The first magnetic path merges with the second magnetic path at the middle leg of the second E-core half to again form the common magnetic path through the two middle legs.

Generally, the two E-core halves are configured to accommodate the flux density generated by the coil wound about the middle legs of the E-core halves. In many E-core configurations, the cross-sectional area of each outer leg and the body portion of each E-core half is at least half the cross-sectional area of the middle leg of each E-core half such that the flux densities of the first and second magnetic paths in the outer legs and the body portions does not exceed the flux density in the middle legs.

E-core halves are configured with many different leg lengths, body widths and body thicknesses for different applications. In general, a bobbin is configured to accommodate commercially available E-core halves to avoid the cost of manufacturing an E-core half with custom dimensions.

Heretofore, bobbins are configured to accommodate the pair of E-core halves in one of two orientations. Most commonly, a bobbin is configured to receive the middle legs of the E-core halves with the overall length and width of each E-core half oriented in a plane parallel to the surface of a printed circuit board (or other mounting surface). The thickness of E-core half is in oriented in a direction normal to the surface of the printed circuit board. This configuration is referred to herein as the "horizontal" core configuration. Less commonly, a bobbin is configured to receive the middle legs of the E-core halves with the overall length and width of each E-core half oriented in a vertical plane perpendicular to the surface of a printed circuit board. The thickness of each E-core half is oriented in a direction parallel to the surface of the printed circuit board. In either configuration of the bobbin, longest dimension—the overall width of each E-core half—is parallel to the surface of the printed circuit board. Thus, the bobbin must be spaced apart from other components on the printed circuit board by a sufficient amount to accommodate the overall width of the E-core halves.

SUMMARY

A need exists for a bobbin configuration that reduces the greatest dimension the magnetic component such that a bobbin requires a smaller area of a surface of a printed circuit board.

One aspect of the embodiments disclosed herein is a bobbin comprising a main body, a first pin support, a second pin support, a third pin support, and a fourth pin support. The main body has a first end flange, a second end flange, a generally rectangular passageway spanning between the first and second end flanges. An outer winding surface surrounds the passageway. The passageway has a first open end and a second open end. The first open end is collinear with an outer surface of the first end flange and the second open end is collinear with an outer surface of the second end flange. The passageway has a first side inner surface, a second side inner surface, an upper inner surface, and a lower inner surface. The first side inner surface is configured to define a first vertical plane. The second side inner surface is configured to define a second vertical plane. The lower inner surface is configured to define a first horizontal plane. Each of the first and second pin supports extends from the outer surface of the first end flange. Each of the first and second pin supports has a respective lower surface positioned below and parallel with the first horizontal plane. The first pin support is positioned adjacent to the first vertical plane, and the second pin support is positioned adjacent to the second vertical plane. The first pin support is spaced apart from the second pin support by at least a width of the passageway. Each of the third and fourth pin supports extends from the outer surface of the second end flange. Each of the third and fourth pin supports has a respective lower surface positioned below and parallel with the first horizontal plane. The third pin support is positioned adjacent to the first vertical plane and the fourth pin support is positioned adjacent to the second vertical plane. The third pin support is spaced apart from the fourth pin support by at least the width of the passageway.

In certain embodiments in accordance with this aspect, each respective lower surface of the first, second, third, and fourth pin supports has a respective pin extending perpendicularly therefrom.

In certain embodiments in accordance with this aspect, each respective lower surface of the first, second, third, and fourth pin supports is aligned with a second horizontal plane. The second horizontal plane is parallel with the first horizontal plane.

In certain embodiments in accordance with this aspect, each of the first, second, third, and fourth pin supports has a respective upper surface. The first end flange includes a first flange slot and a second flange slot. The first flange slot is positioned above the upper surface of the first pin support and extends from an outer periphery of the first end flange toward the outer winding surface of the main body. The second flange slot is positioned above the upper surface of the second pin support and extends from the outer periphery of the first end flange toward the outer winding surface of the main body. The second end flange includes a third flange slot and a fourth flange slot. The third flange slot is positioned above the upper surface of the third pin support and extends from an outer periphery of the second end flange toward the outer winding surface of the main body. The fourth flange slot is positioned above the upper surface of the fourth pin support and extends from the outer periphery of the second end flange toward the outer winding surface of the main body.

In certain embodiments in accordance with this aspect, each respective upper surface of the first, second, third, and fourth pin supports is positioned below the first horizontal plane.

In certain embodiments in accordance with this aspect, a winding is wound around the outer winding surface of the main body between the first end flange and the second end flange. The winding has a first end portion and a second end portion. The first end portion of the winding extends through a first selected flange slot. The first selected flange slot is one of the first flange slot, the second flange slot, the third flange slot, or the fourth flange slot. The first end portion is further connected to a pin associated with the pin support adjacent to the first selected flange slot. The second end portion of the winding extends through a second selected flange slot. The second selected flange slot is a different one of the first flange slot, the second flange slot, the third flange slot, or the fourth flange slot. The second end portion of the winding is further connected to a pin associated with the pin support adjacent to the second selected flange slot.

In certain embodiments in accordance with this aspect, the bobbin further comprises a first wall, a second wall, a third wall, and a fourth wall. The first wall extends perpendicularly from the first end flange and is positioned parallel to the first vertical plane. The first wall is coupled to the first pin support and is positioned between the first pin support and the first vertical plane. The second wall extends perpendicularly from the first end flange and is positioned parallel to the second vertical plane. The second wall is coupled to the second pin support and is positioned between the second pin support and the second vertical plane. The third wall extends perpendicularly from the second end flange and is positioned parallel to the first vertical plane. The third wall is coupled to the third pin support and is positioned between the third pin support and the first vertical plane. The fourth wall extends perpendicularly from the second end flange and is positioned parallel to the second vertical plane. The fourth wall is coupled to the fourth pin support and is positioned between the fourth pin support and the second vertical plane.

In certain embodiments in accordance with this aspect, the first pin support includes a first pin support slot positioned between a portion of the first pin support and the first wall. The second pin support includes a second pin support slot positioned between a portion of the second pin support and the second wall. The third pin support includes a third pin support slot positioned between a portion of the third pin support and the third wall. The fourth pin support includes a fourth pin support slot positioned between a portion of the fourth pin support and the fourth wall.

In certain embodiments in accordance with this aspect, each of the first, the second, the third, and the fourth pin support slots are configured to be able to receive an end portion of a winding.

In certain embodiments in accordance with this aspect, each of the first, second, third, and fourth walls has a respective upper portion that extends above a respective upper surface of the first, second, third, and fourth pin supports.

In certain embodiments in accordance with this aspect, each of the first and second walls has a respective lower portion that extends below an outer periphery of the first end flange. Each of the third and fourth walls has a respective lower portion that extends below an outer periphery of the second end flange. The respective lower portions of each of the first, second, third, and fourth walls are configured to support the bobbin when the bobbin is installed on a printed circuit board.

In certain embodiments in accordance with this aspect, the bobbin further comprises a first E-core half and a second E-core half. The first E-core half has a vertical body portion, a middle leg, a first outer leg, and a second outer leg. The body portion is positioned adjacent to the outer surface of the first end flange. The middle leg extends perpendicularly from the body portion and is positioned in the first open end of the passageway. The first outer leg extends perpendicularly from the body portion and is positioned adjacent to an upper portion of an outer periphery of the first end flange. The second outer leg extends perpendicularly from the body portion and is positioned adjacent to a lower portion of the outer periphery of the first end flange. The second E-core half has a vertical body portion, a middle leg, a first outer leg, and a second outer leg. The body portion is positioned adjacent to the outer surface of the second end flange. The middle leg extends perpendicularly from the body portion and is positioned in the second open end of the passageway. The first outer leg extends perpendicularly from the body portion and is positioned adjacent to an upper portion of an outer periphery of the second end flange. The second outer leg extends perpendicularly from the body portion and is positioned adjacent to a lower portion of the outer periphery of the second end flange.

In certain embodiments in accordance with this aspect, each of the first and second E-core halves are positioned entirely between the first vertical plane and the second vertical plane.

Another aspect of the embodiments disclosed herein is a magnetic component comprising a bobbin, a first E-core half, and a second E-core half. The bobbin includes a first end flange, a second end flange, and a passageway spanning between the first end flange and the second end flanges. The bobbin further includes a first pin support, a second pin support, a third pin support, and a fourth pin support. The first and second pin supports extend from an outer surface of the first end flange and are spaced apart by at least a width of the passageway. The third and fourth pin supports extend from an outer surface of the second end flange and are spaced apart by at least the width of the passageway. The bobbin further includes a first wall, a second wall, a third wall, and a fourth wall. The first and second walls extend perpendicularly from the outer surface of the first end flange and are spaced apart by at least the width of the passageway. The first wall is coupled to the first pin support, and the second wall is coupled to the second pin support. Each of the first and second walls extends below an outer periphery of the first end flange by at least a first distance. The third and fourth walls extend perpendicularly from the outer surface of the second end flange and are spaced apart by at least the width of the passageway. The third wall is coupled to the third pin support, and the fourth wall is coupled to the fourth pin support. Each of the third and fourth walls extends below an outer periphery of the second end flange by at least the first distance. Each of the first E-core half and the second E-core half has a body portion, a middle leg, a first outer leg, and a second outer leg. The body portion of the first E-core half is positioned vertically and is positioned adjacent to the outer surface of the first end flange between the first and second walls. The body portion of the first E-core half extends above and below the outer periphery of the first end flange by a second distance that is less than the first distance. The body portion of the second E-core half is positioned vertically and is positioned adjacent to the outer surface of the second end flange between the first and second walls. The body portion of the second E-core half extends above and below the outer periphery of the second end flange by the second distance. The middle leg of each of the first and second E-core halves extends into the passageway from opposite ends of the passageway. The first outer leg of each of the first and second E-core halves is positioned above the passageway of the bobbin adjacent to the outer periphery of the first end flange or second end flange, respectively. The second outer leg of each of the first and second E-core halves is positioned below the passageway of the bobbin adjacent to the outer periphery of the first end flange or second end flange, respectively.

In certain embodiments in accordance with this aspect, each of the first, second, third, and fourth pin supports includes a respective lower surface with a respective pin extending therefrom by a third distance. The third distance is greater than the first distance.

In certain embodiments in accordance with this aspect, the magnetic component further comprises a winding wound around an outer surface of the bobbin surrounding the passageway between the first end flange and the second end flange. The winding has a first end portion and a second end portion. The first end portion of the winding is connected to a first selected pin. The first selected pin is the respective pin of one of the first pin support, the second pin support, the third pin support, or the fourth pin support. The second end portion of the winding is connected a second selected pin. The second selected pin is the respective pin of a different one of the first pin support, the second pin support, the third pin support, or the fourth pin support.

In certain embodiments in accordance with this aspect, the first end portion of the winding is positioned through a respective flange slot and a respective pin support slot. The respective flange slot and the respective pin support slot are each associated with the first selected pin. In accordance with this aspect, the second end portion of the winding is positioned through a respective flange slot and a respective pin support slot. The respective flange slot and the respective pin support slot are each associated with the second selective pin.

In certain embodiments in accordance with this aspect, the body portion, the middle leg, the first outer leg, the second outer leg of the first and second E-core halves have a common thickness being substantially equal to the width of the passageway In certain embodiments in accordance with this aspect, the first and second outer legs of the first and second E-core halves have a common width being substantially equal to the second distance.

Another aspect of the embodiments disclosed herein is a method for assembling a magnetic component. The method includes providing a bobbin having a first outer flange, a second outer flange, and a passageway spanning between the first and second outer flanges. The passageway includes a first passageway end open to the first outer flange and a second passageway end open to the second outer flange. The bobbin further includes a first pin support, a second pin support, a third pin support, and a fourth pin support. Each of the first and second pin supports extends from an outer surface of the first outer flange and are spaced apart by at least a width of the passageway. Each of the third and fourth pin supports extends from an outer surface of the second outer flange. The third and fourth pin supports are spaced apart by at least the width of the passageway. Each of the first, second, third, and fourth pin supports includes a respective pin extending from a respective lower surface. The method further includes inserting a middle leg of a first E-core half into the first passageway end such that a body portion of the first E-core half is positioned vertically relative to the bobbin. First and second outer legs of the first E-core half are positioned above and below an outer periphery of the first outer flange, respectively. The method further includes inserting a middle leg of a second E-core half into the second passageway end such that a body portion of the second E-core half is positioned vertically relative to the bobbin. First and second outer legs of the second E-core half are positioned above and below an outer periphery of the second outer flange, respectively.

In certain embodiments in accordance with this aspect, the method further comprises wrapping a winding around an outer surface of the bobbin between the first outer flange and the second outer flange. A first end portion of the winding is connected to a first selected pin. The first selected pin is the respective pin of one of the first pin support, the second pin support, the third pin support, or the fourth pin support. A second end portion of the winding is connected to a second selected pin. The second selected pin is the respective pin of a different one of the first pin support, the second pin support, the third pin support, or the fourth pin support.

In certain embodiments in accordance with this aspect, the method further comprises routing the first end portion of the winding through a first respective flange slot and a first respective pin support slot. The first respective flange slot and the first respective pin support slot are associated with the first selected pin. The second end portion of the winding is routed through a second respective flange slot and a second respective pin support slot. The second respective flange slot and the second respective pin support slot are associated with the second selected pin.

BRIEF DESCRIPTIONS OF THE SEVERAL VIEWS OF THE DRAWINGS

DETAILED DESCRIPTION

Reference will now be made in detail to embodiments of the present disclosure, one or more drawings of which are set forth herein. Each drawing is provided by way of explanation of the present disclosure and is not a limitation. It will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

It is intended that the present disclosure covers such modifications and variations as come within the scope of the appended claims and their equivalents. Other objects, features, and aspects of the present disclosure are disclosed in the following detailed description. It is to be understood by one of ordinary skill in the art that the present discussion is a description of exemplary embodiments only and is not intended as limiting the broader aspects of the present disclosure.

Figure 1A:
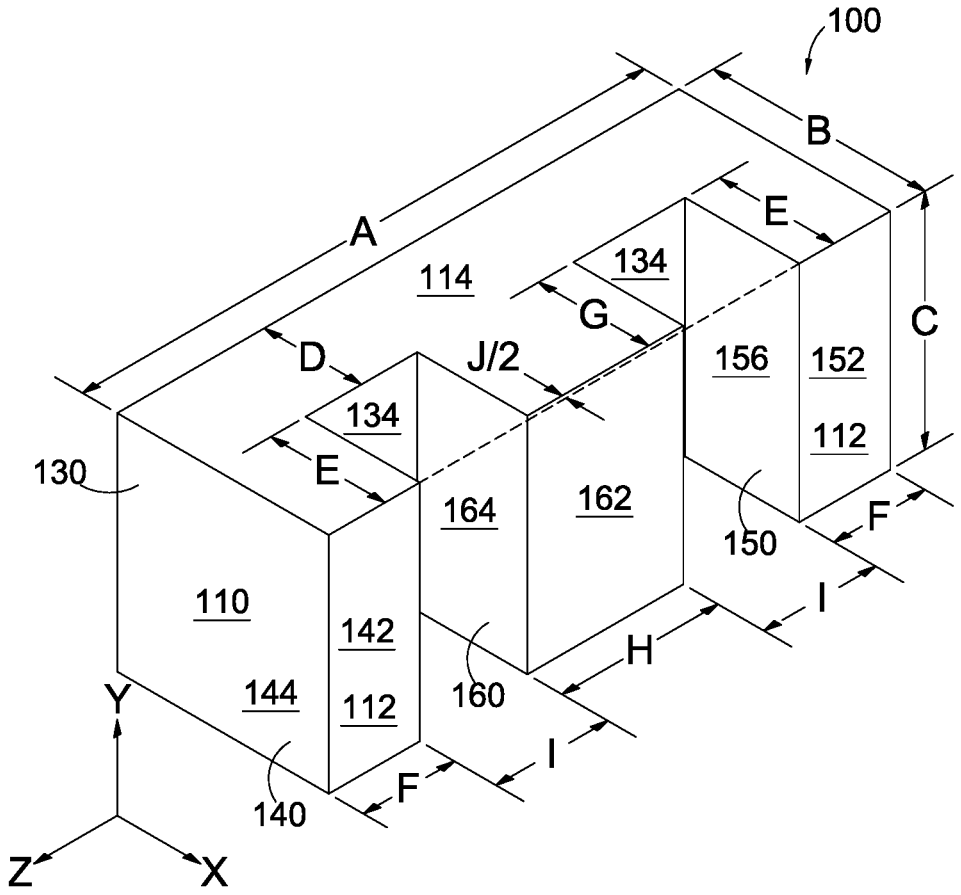
Fig. 1A (Prior Art)
FIG. 1A illustrates a perspective view of a conventional E-core half showing a front surface, a right surface, and a top surface of the E-core.
Figure 1B:
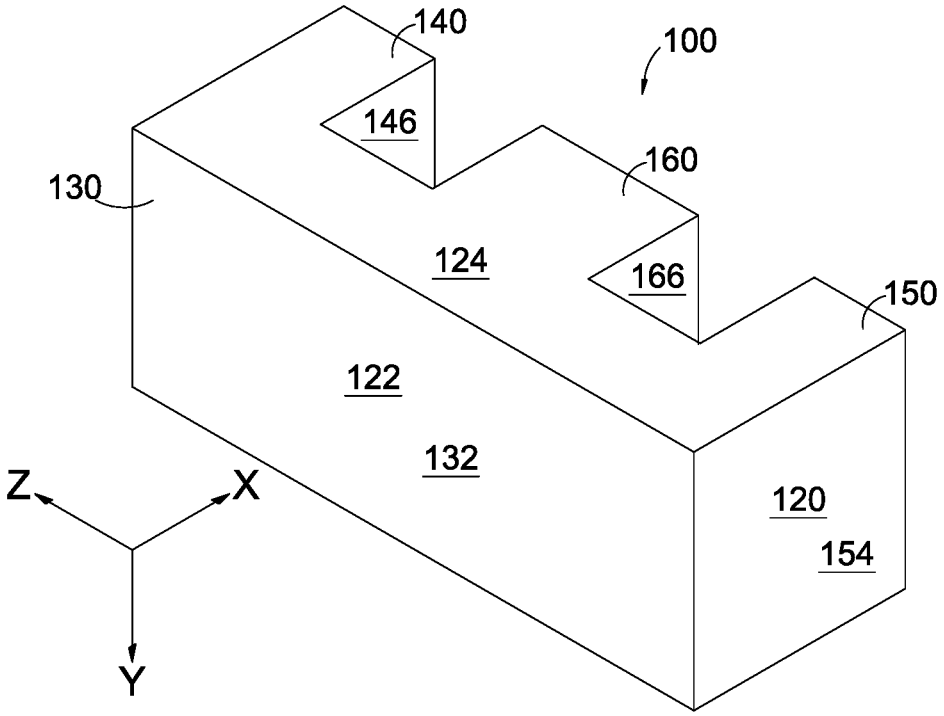
Fig. 1B (Prior Art)
FIG. 1B illustrates a perspective view of the E-core half of FIG. 1 showing a back surface, a left surface, and a bottom surface.

FIG. 1A illustrates a perspective view of a conventional E-core half 100. Using a conventional X, Y, Z coordinate system, the view in FIG. 1A shows a front surface 110, a right surface 112 and a top surface 114 of the E-core half. FIG. 1B illustrates a rotated perspective view of the conventional E-core half of FIG. 1A, which is rotated 180 degrees about the Z-axis and then rotated 90 degrees clockwise about the Y-axis. The view in FIG. 1B shows a back surface 120, a left surface 122 and a bottom surface 124. As illustrated, the front and back surfaces are interchangeable, and the top and bottom surfaces are interchangeable. Furthermore, the overall orientation of the E-core half may be changed to re-designate the identifications of each surface. Accordingly, identified surfaces are used for reference in the following discussion and are not intended to be a limitation on the orientation of the E-core except as may be specifically stated herein.

The E-core half 100 has an overall width from the front surface 110 to the back surface 120, which is designated by the dimension A in FIG. 1A. The E-core half has an overall length from the right surface 112 to the left surface 122, which is designated by the dimension B in FIG. 1A. The E-core half has a thickness from the top surface 114 to the bottom surface 124, which is designated by the dimension C in FIG. 1A.

The E-core half 100 comprises a body portion 130 that extends from the front surface 110 to the back surface 120. To be consistent with the overall structure of the E-core half, the distance from the front surface to the back surface is identified herein as the width of the body portion. The body portion is bounded by an outer surface 132 and an inner surface 134. The outer surface of the body portion corresponds to the left surface 122 of the overall structure. The inner surface of the body portion is parallel to the right surface 112 of the overall structure and is displaced from the right surface. The distance from the outer surface to the inner surface of the body portion is designated by a dimension D in FIG. 1, which is referred to herein as the length of the body portion. In the illustrated embodiment, the body portion has the thickness C from the top surface 114 to the bottom surface 124, which corresponds to the thickness of overall structure of the E-core half.

Three legs extend from the body portion 130 of E-core half 100. A first outer leg 140 extends from the inner surface 134 of the body portion to a first outer leg end surface 142. The first outer leg has a length E in a direction normal to the left surface 122 of the E-core half. The first outer leg has a width F from a first outer leg outer surface 144 to a first outer leg inner surface 146 in a direction normal to the front surface 110 of the E-core half. In the illustrated embodiment, the first outer leg outer surface is coplanar with the front surface of the E-core half. In the illustrated embodiment, the first leg has the thickness C from the top surface 114 to the bottom surface 124, which corresponds to the thickness of overall structure of the E-core half.

A second outer leg 150 extends from the inner surface 134 of the body portion 130 to a second outer leg end surface 152. In the illustrated embodiment, the second outer leg has the length E in the direction normal to the left surface 122 of the E-core half. The second outer leg has the width F from a second outer leg outer surface 154 to a second outer leg inner surface 156 in a direction normal to the back surface 120 of the E-core half 100. In the illustrated embodiment, the second outer leg outer surface is coplanar with the back surface of the E-core half. In the illustrated embodiment, the second leg has the thickness C from the top surface 114 to the bottom surface 124, which corresponds to the thickness of overall structure of the E-core half.

A middle leg 160 extends from the inner surface 134 of the body portion 130 to a middle leg end surface 162. In the illustrated embodiment, the middle leg has a length G in the direction normal to the left surface 122 of the E-core half. The middle leg has the width H from a first middle lateral surface 164 to a second middle lateral surface 166 in a direction normal to the front surface 110 of the E-core half 100. In the illustrated embodiment, the middle leg has the thickness C from the top surface 114 to the bottom surface 124, which corresponds to the thickness of overall structure of the E-core half. In other embodiments (not shown), one or both of the top surface and the bottom surface of the middle leg may be offset from respective top surface and bottom surface of the overall structure.

In the illustrated embodiment, the middle leg end surface 162 is not coplanar with the first outer leg end surface 142 and the second outer leg end surface 152. Rather, the middle leg end surface is offset from outer leg end surfaces by a gap J/2 as shown in FIG. 1B. The gap J/2 is selected to be one-half a desired gap distance such that when the E-core half 100 is abutted with a similar E-core half (as described below) with end surfaces of the outer legs engaged, the end surfaces of the middle legs will be spaced apart by a gap J. In other embodiments (not shown) where no gap is desired between the end surfaces of the middle legs, the middle leg end surface may be coplanar with the end surfaces of the first and second outer legs.

Each of the foregoing dimensions may be varied to provide a desired electromagnetic characteristic for the E-core half. The following description is directed to an E-core having particular dimensions; however, the description and the beneficial effects of the described embodiment are readily adapted to E-core halves having different dimensions.

One commonly used E-core half 100 is commercially available from TSC Ferrite International, which uses a combination of three numbers as a part number that also identifies the approximate outer dimensions of a particular E-core half. For example, TSC Part No. 28-11-11 identifies a ferrite E-core half having an overall width (dimension A in FIG. 1A) of approximately 27.99 millimeters, an overall length (dimension B in FIG. 1A) of approximately 10.54 millimeters and an overall thickness (dimension C in FIG. 1A) of approximately 11.18 millimeters. Other dimensions, including the widths of the legs, the width of body portion and the spacing between the outer legs are specified for each configuration of E-core half. For example, the 28-11-11 ferrite E-core half from TSC has the following approximate dimensions:

A: 28.00 millimeters
B: 10.54 millimeters
C: 11.18 millimeters
D: 4.85 millimeters
E: 5.69 millimeters
F: 4.35 millimeters
G: 5.30 millimeters
H: 7.70 millimeters
5.80 millimeters
J/2: 0.05 millimeter Similar sized cores from other sources may have different dimension; however, in general, the width A of the E-core half 100 is substantially greater than the length B of the E-core half and substantially greater than the thickness C of the E-core half. For example, in the illustrated E-core half, the width A is more than 50 percent greater than the length B (e.g., $A>1.5\times B$). When two E-core halves are positioned with the end surfaces of the respect outer legs abutting, the width A is more than 25 percent greater than the combined lengths of the abutting outer legs (e.g., $A>1.25\times(2\times B)$).

Heretofore, two E-core halves 100 have been installed in bobbins in either of two configurations. A first common configuration, referred to herein as the horizontal configuration, is illustrated in FIGS. 2-5. A second common configuration, referred to herein as the vertical configuration, is illustrated in FIGS. 6-9.

Figure 2:
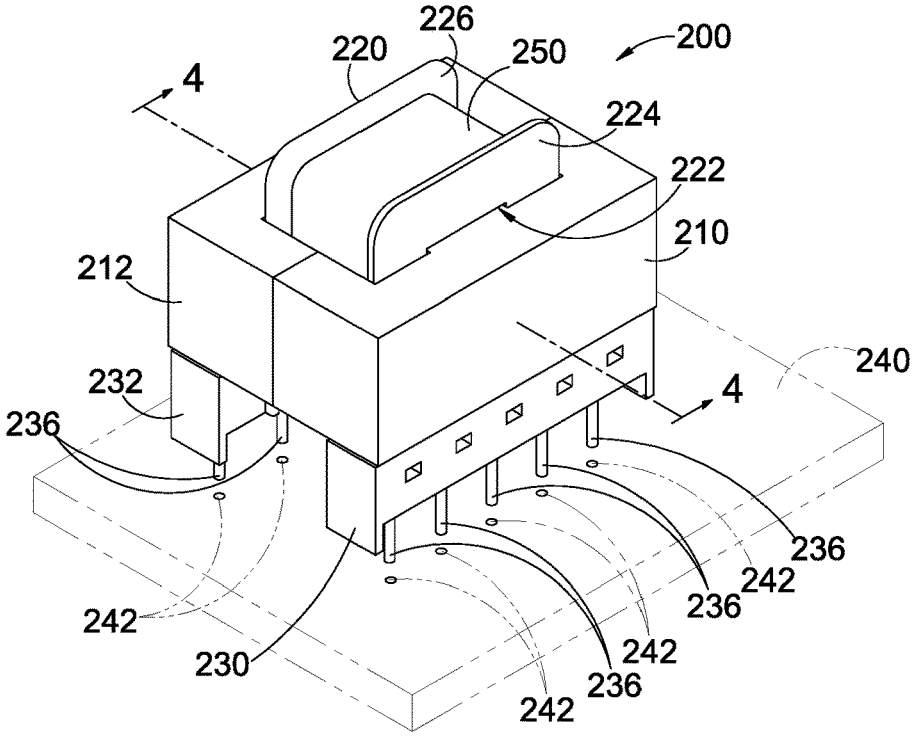
Fig. 2 (Prior Art)
FIG. 2 illustrates a perspective view of a conventional horizontal mount magnetic component.
Figure 3:
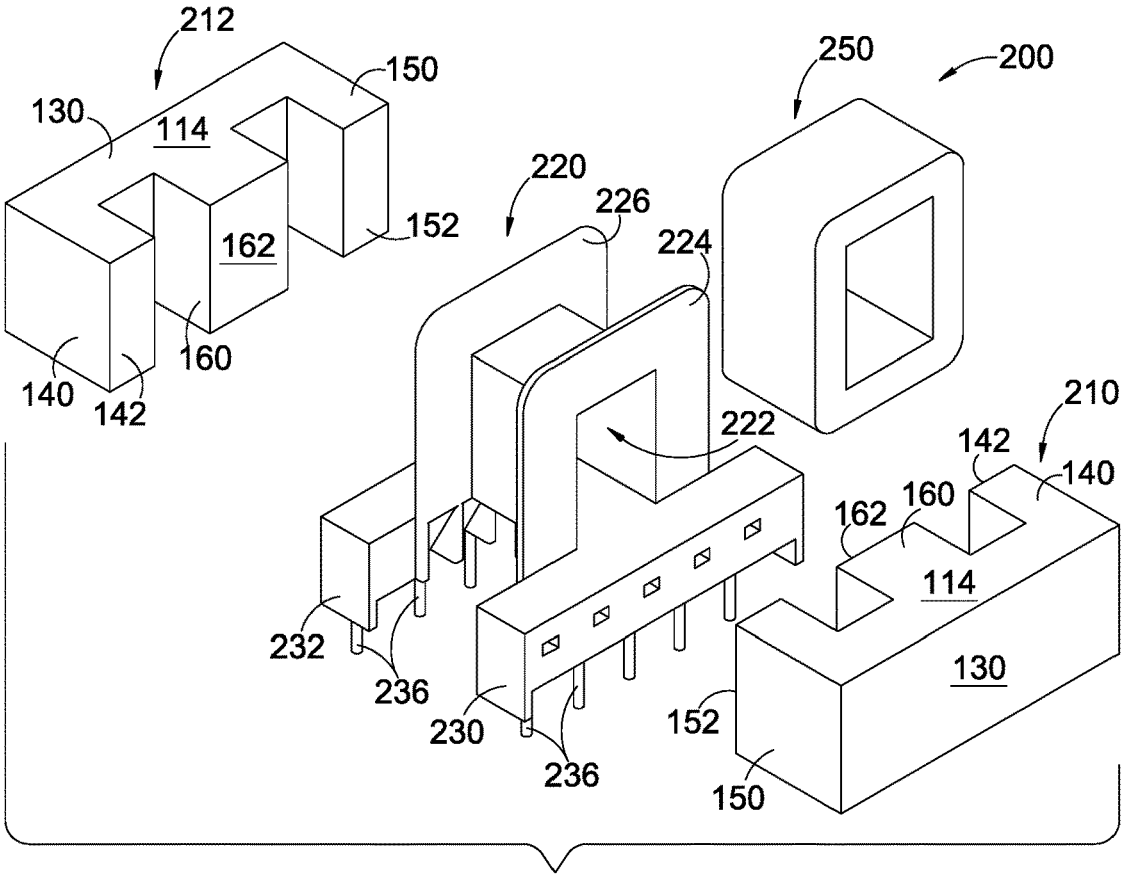
Fig. 3 (Prior Art)
FIG. 3 illustrates an exploded perspective view of the magnetic component of FIG. 2.

As shown in FIGS. 2-5 for the horizontal configuration, a magnetic component 200 comprises a first E-core half 210 and a second E-core half 212. Each E-core half in FIGS. 2-5 corresponds to the E-core half 100 of FIGS. 1A and 1B. In FIGS. 2 and 3, the second E-core half is oriented as shown in FIG. 1A. The first E-core half is rotated 180 degrees with respect to the orientation of FIG. 1A.

Figure 4:
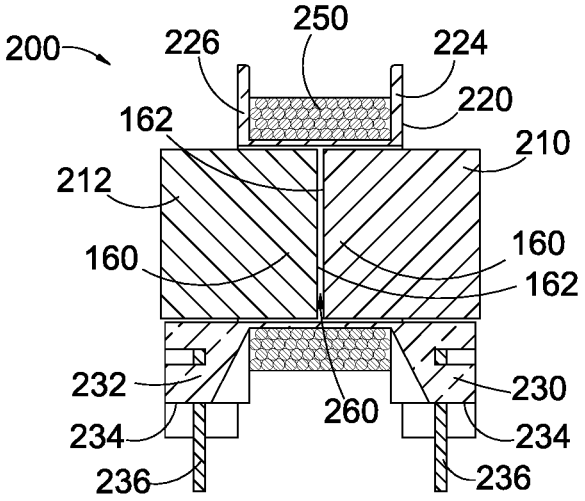
Fig. 4 (Prior Art)
FIG. 4 illustrates a cross-sectional view of the magnetic component of FIG. 2 taken along line 4-4 of FIG. 2.

A bobbin 220 includes a passageway 222, which extends horizontally through the bobbin from a first outer flange 224 to a second outer flange 226. The bobbin includes a first pin rail 230, which extends downward (as oriented in FIGS. 2-5) from the first outer flange. The bobbin includes a second pin rail 232, which extends downward from the second outer flange. Each pin rail has a respective horizontal lower surface 234 (FIG. 4). A respective plurality of terminal pins 236 extend downwardly from the respective lower surfaces of the pin rail. The terminal pins are positioned to engage a plural of cylindrical contact holes 242 in a horizontally disposed printed circuit board (PCB) 240 (shown in phantom in FIG. 2). At least two of the terminal pins from the pin rails are electrically connected to at least one coil 250, which is wrapped around the passageway in a conventional manner. Although illustrated as a single coil, two or more coils may be wrapped around the passageway. Multiple coils may be separated by one or more intermediate flanges (not shown) positioned between the first outer flange and the second outer flange.

The respective middle legs 160 of the two E-core halves are installed into the passageway 222 from opposite ends of a bobbin 220. As illustrated, the middle leg of the first E-core half 210 is inserted into the passageway from the direction of the first outer flange 222. The middle leg of the second E-core half 212 is inserted into the passageway from the direction of the second outer flange 224. When the middle legs of the two E-core halves are fully inserted as shown in FIG. 2, the end surface 142 of the first outer leg 140 of the first E-core half abuts the end surface 152 of the second outer leg 150 of the second E-core half. In like manner, the end surface of the second outer leg of the first E-core half abuts the end surface of the first outer leg of the second E-core half. In FIGS. 2-4, the first E-core half and the second E-core half are positioned with their respective top surfaces 114 in the same horizontal plane. It should be understood that the second E-core half may be rotated with respect to the first E-core half such that the bottom surface of the second E-core half is coplanar with the top surface of the first E-core half, in which case, the respective end surfaces of the first outer legs of the two E-core halves abut each other and the respective end surfaces of the second outer legs of the two E-core halves abut each other. Because of the symmetry of the two core halves, either of the outer legs of an E-core half may be considered to be the first outer leg with the other outer leg being the second outer leg.

In the illustrated embodiment, the respective middle legs 160 of the two E-core halves 210, 212 are shorter than the respective first and second outer legs 140, 150 of the two E-core halves by the distance J/2. Thus, as shown in the cross-sectional view of FIG. 4, the end surfaces 162 of the middle legs are spaced apart from each other by a gap 260, which has a total gap length of J. In one embodiment, J may be approximately 0.1 millimeter.

Figure 5:
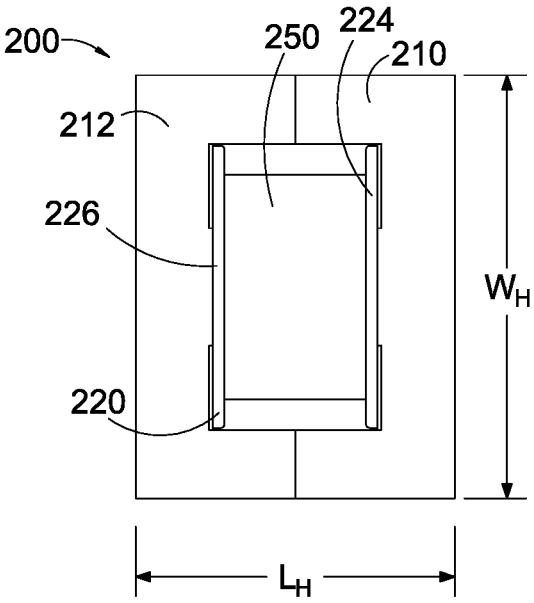
Fig. 5 (Prior Art)
FIG. 5 illustrates a top plan view of the magnetic component of FIG. 2.

In the embodiment of FIGS. 2-5, the magnetic component 200 in the horizontal configuration occupies a minimum horizontal surface area determined by the overall dimensions of the two E-core halves. For example, as shown in FIG. 5, a minimum width $W_H$ of the magnetic component is the distance A. A minimum length $L_H$ of the magnetic component is twice the overall length B of each core half (e.g., L=2×B). Using the foregoing dimensions of the conventional TSC 28-11-11 ferrite E-core half 100 as an example, the magnetic component of FIGS. 2-5 has a minimum area of approximately 588 square millimeters (e.g., 28×2×10.5 $mm^2$ or approximately 0.91 square inches). In other embodiments (not shown), the pin rails of the horizontal configuration of the magnetic component 200 may extend beyond the boundaries of the outer core legs of the two E-core halves, and the area required for the horizontal configuration will increase accordingly. For example, in one conventional embodiment, the pin rails extend approximately 1.25 millimeters beyond the outer legs of the two E-core halves. In such an embodiment, the minimum area increases to approximately 640 square millimeters (e.g., 30.5×2×10.5 $mm^2$ or approximately 0.99 square inches).

Figure 6:
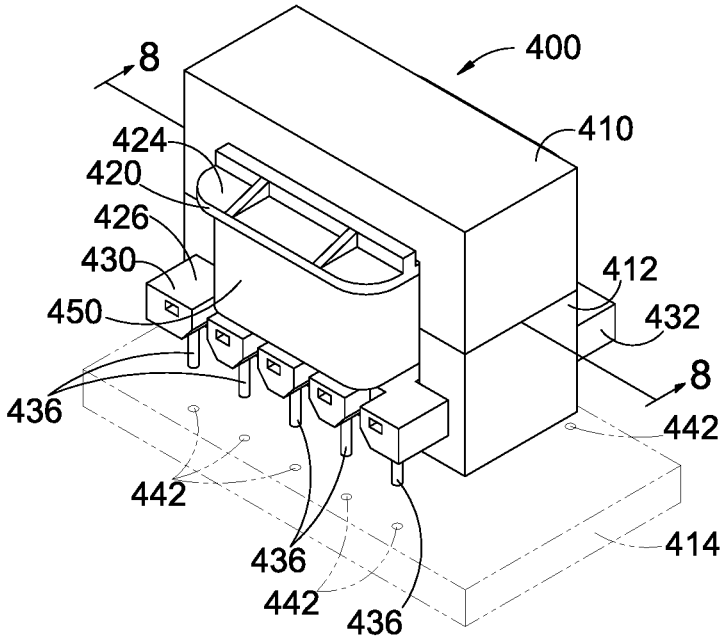
Fig. 6 (Prior Art)
FIG. 6 illustrates a perspective view of a conventional vertical mount magnetic component.
Figure 7:
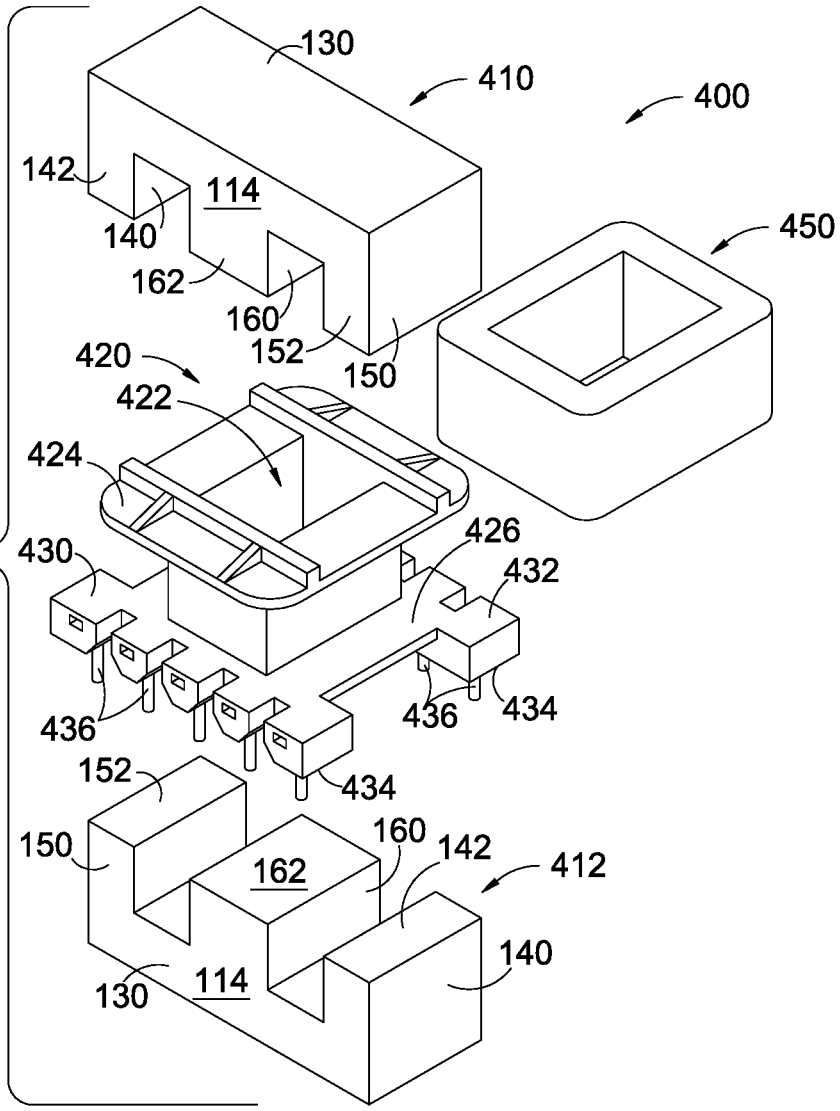
Fig. 7 (Prior Art)
FIG. 7 illustrates an exploded perspective view of the magnetic component of FIG. 6.

As shown in FIGS. 6-9 for the vertical configuration, a magnetic component 400 comprises a first E-core half 410 and a second E-core half 412. Each E-core half in FIGS. 6-9 corresponds to the E-core half 100 of FIGS. 1A and 1B. In FIGS. 6 and 7, the first E-core half is oriented with the legs 140, 150, 160 extending vertically downward from the horizontally disposed body portion 130 of the first E-core half. The second E-core half is rotated 180 degrees with respect to the orientation of the first E-core half such that the legs of the second E-core half extend vertically upward from the horizontally disposed body portion of the second E-core half. As discussed above, horizontally and vertically are referenced to the surface of a PCB 414 (shown in phantom lines) onto which the magnetic component may be mounted.

Figure 8:
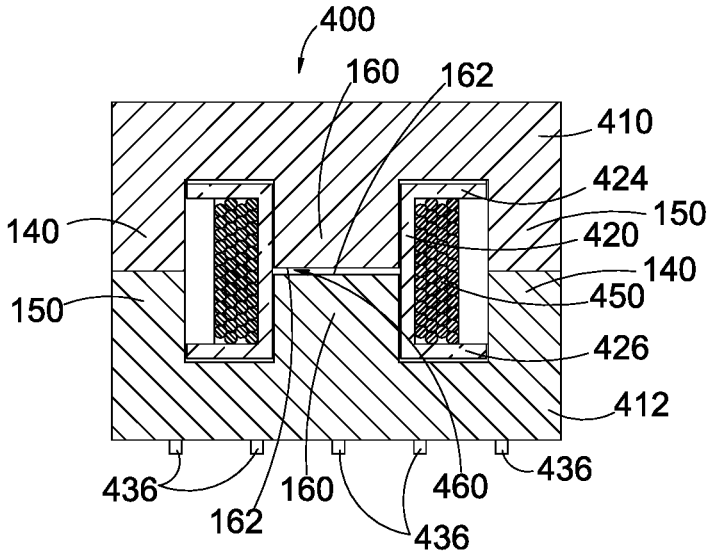
Fig. 8 (Prior Art)
FIG. 8 illustrates a cross-sectional view of the magnetic component of FIG. 6 taken along line 8-8 of FIG. 6.

A bobbin 420 includes a passageway 422, which extends vertically through the bobbin from a first (upper) outer flange 424 to a second (lower) outer flange 426. The bobbin includes a first pin rail 430, which extends downward (as oriented in FIGS. 6-9) from the second (lower) outer flange on one side of the passageway. The bobbin includes a second pin rail 432, which also extends downward from the second (lower) outer flange on an opposite side of the passageway. Each pin rail has a respective horizontal lower surface 434. A respective plurality of terminal pins 436 extend downwardly from the respective lower surfaces of the pin rail. The terminal pins are positioned to engage a plural of cylindrical contact holes 442 (shown in phantom) in the horizontally disposed PCB 414. As shown in FIG. 8, the terminal pins extend sufficiently below the second E-core half 412 to engage contact holes. At least two of the terminal pins from the pin rails are electrically connected to at least one coil 450, which is wrapped around the vertical passageway in a conventional manner. Although illustrated as a single coil, two or more coils may be wrapped around the passageway. Multiple coils may be separated by one or more intermediate flanges (not shown) positioned between the first (upper) outer flange and the second (lower) outer flange.

The respective middle legs 160 of the two E-core halves are installed vertically into the passageway 422 from opposite ends of a bobbin 420. As illustrated, the middle leg of the first E-core half 410 is inserted downwardly into the passageway from the direction of the first outer flange 422. The middle leg of the second E-core half 412 is inserted upwardly into the passageway from the direction of the second outer flange 424. When the middle legs of the two E-core halves are fully inserted as shown in FIG. 6, the end surface 142 of the first outer leg 140 of the first E-core half abuts the end surface 152 of the second outer leg 150 of the second E-core half. In like manner, the end surface of the second outer leg of the first E-core half abuts the end surface of the first outer leg of the second E-core half. In FIGS. 6-9, the first E-core half and the second E-core half are positioned with their respective top surfaces 114 (as oriented in FIGS. 1A and 1B) in the same vertical plane. It should be understood that the second E-core half may be rotated with respect to the first E-core half such that the bottom surface of the second E-core half is coplanar with the top surface of the first E-core half, in which case, the respective end surfaces of the first outer legs of the two E-core halves abut each other and the respective end surfaces of the second outer legs of the two E-core halves abut each other. Because of the symmetry of the two core halves, either of the outer legs of an E-core half may be considered to be the first outer leg with the other outer leg being the second outer leg.

In the illustrated embodiment, the respective middle legs 160 of the two E-core halves 410, 412 are shorter than the respective first and second outer legs 140, 150 of the two E-core halves by the distance J/2. Thus, as shown in the cross-sectional view of FIG. 8, the end surfaces 162 of the middle legs are spaced apart from each other by a gap 460, which has a total gap length of J. In one embodiment, J may be approximately 0.1 millimeter.

Figure 9:
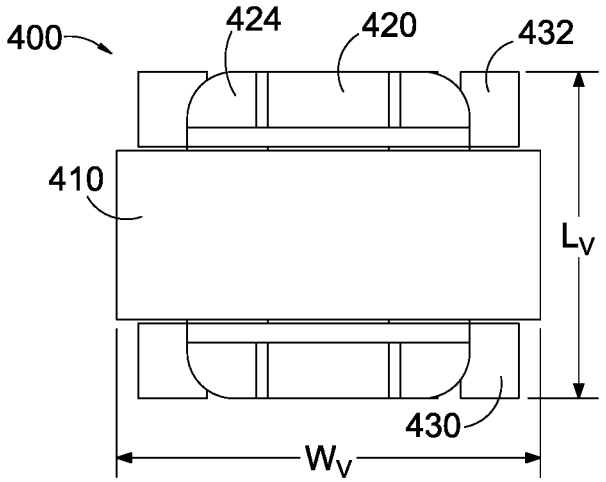
Fig. 9 (Prior Art)
FIG. 9 illustrates a top plan view of the magnetic component of FIG. 6.

In the embodiment of FIGS. 6-9, the magnetic component 400 in the vertical configuration occupies a minimum horizontal surface area determined by the width A of the two E-core halves and by the size of second (lower) outer flange 424 of the bobbin 420 needed to accommodate the coil 450 and to support the first and second pin rails 430, 432. For example, as shown in FIG. 9, a minimum width $W_V$ of the magnetic component is the distance A. A minimum length $L_H$ of the magnetic component is the distance between the outer boundaries of the flanges in a direction perpendicular to the width of the E-core halves. In one embodiment, the length $L_H$ is approximately 21.6 millimeters. Using the foregoing dimensions of the conventional TSC 28-11-11 ferrite E-core half 100 as an example, the magnetic component of FIGS. 6-9 has a minimum area of approximately 604.8 square millimeters (e.g., 28×21.6 $mm^2$ or approximately 0.98 square inches).

Both the horizontal configuration of the magnetic component 200 of FIGS. 2-5 and the vertical configuration of the magnetic component 400 of FIGS. 6-9 include a longest dimension in the horizontal plane (parallel to the surface of the respective PCBs 240, 414) corresponding to the width A of the E-core half 100. Since the width of the E-core half is determined by the commercially available E-core having desired electromagnetic characteristics, the width of the E-core half cannot be changed without replacing the E-core half with another E-core half with different characteristics.

FIGS. 10-16 illustrate a magnetic component 600 having an edge configuration in which a first E-core half 610 and a second E-core half 612 are mounted with the width A of each E-core half oriented vertically with respect to the horizontal plane of an upper mounting surface 616 of a PCB 614 onto which the magnetic component may be installed. The PCB 614 includes a plurality of cylindrical contact holes 618 extending through at least the upper surface 616. By mounting the E-core halves with the body 130 of each E-core half mounted vertically, the longest dimension of the E-core halves is not a factor in the surface area required to mount the magnetic component.

Figure 10:
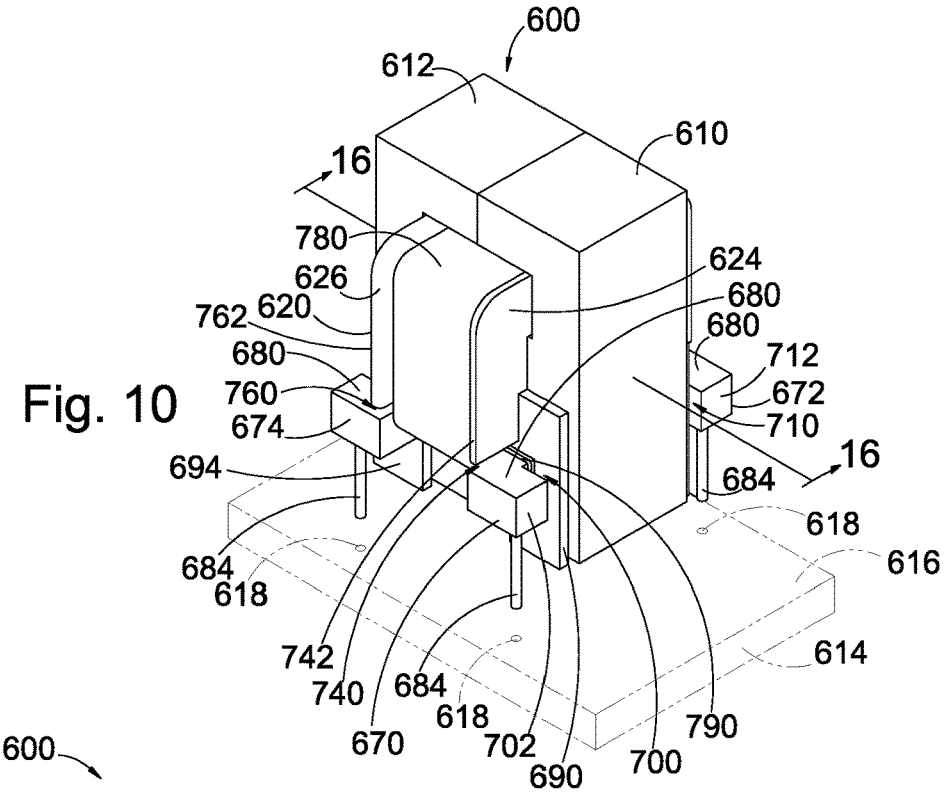
FIG. 10 illustrates a perspective view of an embodiment of an edge mount magnetic component in accordance with the present disclosure.
Figure 11:
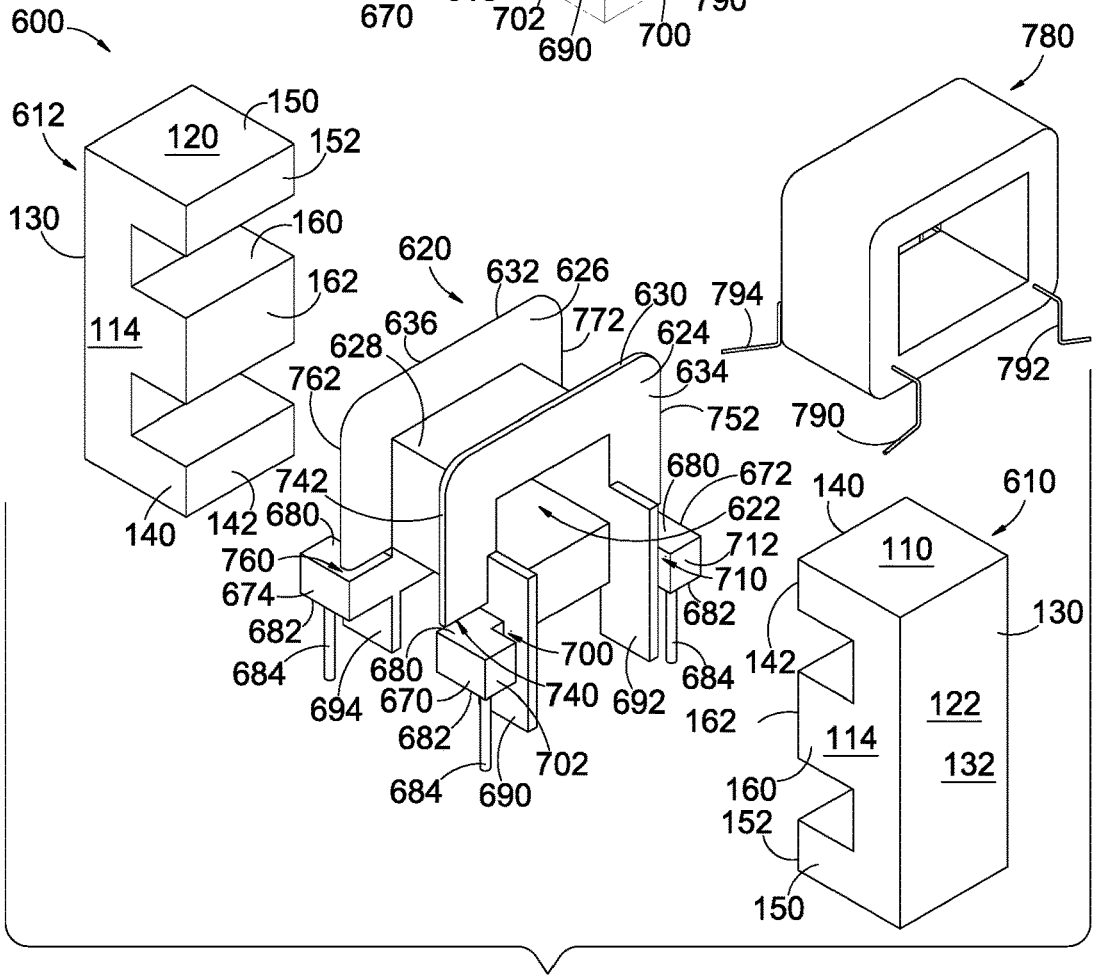
FIG. 11 illustrates an exploded perspective view of the magnetic component of FIG. 10 in accordance with the present disclosure.

Each E-core half 610, 612 in FIGS. 10-16 corresponds to the E-core half 100 of FIGS. 1A and 1B. In FIGS. 10 and 11, the first E-core half is oriented with the legs 140, 150, 160 extending horizontally from the vertically disposed body portion 130 of the first E-core half. The second E-core half is rotated 180 degrees with respect to the orientation of the first E-core half such that the legs of the second E-core half also extend horizontally from the vertically disposed body portion of the second E-core half. Unlike the horizontal configuration of FIGS. 2-5 and the vertical configuration of FIGS. 6-9, wherein the legs of each E-core half are horizontally disposed with respect to each other, the legs of each E-core half in FIGS. 10-16 are vertically disposed with respect to each other such that the middle leg of each E-core half is positioned between a lower outer leg and an upper outer leg as shown in FIG. 11. As discussed above, horizontally and vertically are referenced to the horizontal upper surface of the PCB 614 (shown in phantom lines) onto which the magnetic component may be mounted.

A bobbin 620 of the magnetic component 600 includes a passageway 622, which extends horizontally through the bobbin from a first outer flange 624 to a second outer flange 626. The first outer flange 624 may also be referred to herein as a first end flange 624. The second outer flange 626 may also be referred to herein as a second end flange 626. The bobbin further has an outer winding surface 628 surrounding the passageway and defined between the first and second outer flanges. In the illustrated embodiment, the passageway is rectangular and has a width $W_P$ in a horizontal direction parallel to the upper mounting surface 616 of the PCB 614 and has a height in a vertical direction perpendicular to the upper mounting surface of the PCB. The following measurements are merely provided as an example of one potential embodiment of the magnetic component 600 taking up less PCB 614 board space than and having equivalent electrical characteristics as the above described horizontally and vertically configured magnetic components 200, 400. In the illustrated embodiment, the width $W_P$ of the passageway is approximately 11.64 millimeters and the height of the passageway is approximately 8 millimeters. Each of the first outer flange and the second outer flange is generally rectangular and extends approximately 5.33 millimeters outward from the passageway. Each outer flange has a thickness of approximately 0.89 millimeters inwardly from the respective outer surface The first outer flange 624 has an outer periphery 630 defined as an edge of the outer perimeter of the first outer flange. The second outer flange 626 has an outer periphery 632 defined as an edge of the outer perimeter of the second outer flange. The first outer flange also has an outer surface 634 facing away from the bobbin. The second outer flange also has an outer surface 636 facing away from the bobbin opposite the outer surface 634 of the first outer flange.

The passageway 622 of the bobbin 620 has a first open end 640 and a second open end 642. The first open end 640 may also be referred to herein as a first passageway end 640. The second open end 642 may also be referred to herein as a second passageway end 642. The first open end is surrounded by the first outer flange 624 and is aligned (e.g., collinear) with the outer surface 634 of the first outer flange. The second open end is surrounded by the second outer flange 626 and is aligned with the outer surface 626 of the second outer flange.

The passageway 622 of the bobbin 620 further includes a first side inner surface 650, a second side inner surface 652, an upper inner surface 654, and a lower inner surface 656. The first side inner surface 650 defines a first vertical plane. The first vertical plane is not separately numbered from the surface that defines it. The second side inner surface defines a second vertical plane. The lower inner surface defines a first horizontal plane. Like the first vertical plane, neither the second vertical plane nor the first horizontal plane is separately numbered from the surface that defines each respective plane.

Figure 12:
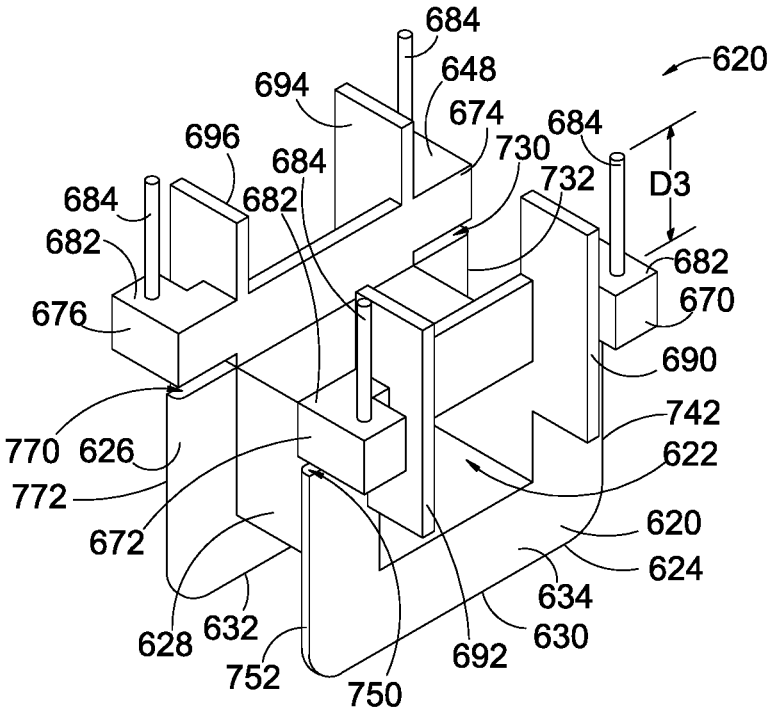
FIG. 12 illustrates a lower perspective view of a bobbin of the magnetic component of FIG. 10 in accordance with the present disclosure.
Figure 13A:
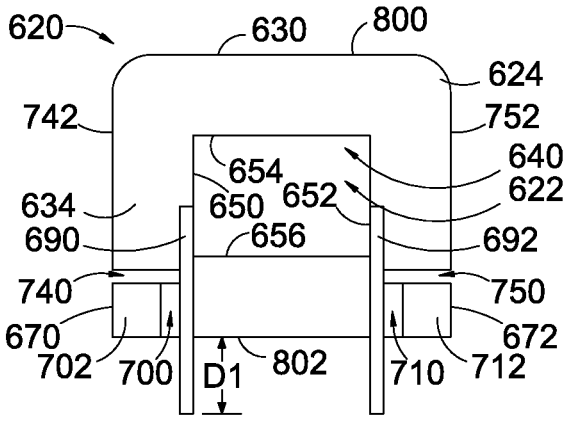
FIG. 13A illustrates a left side elevation view of the bobbin of FIG. 12 in accordance with the present disclosure.
Figure 13B:
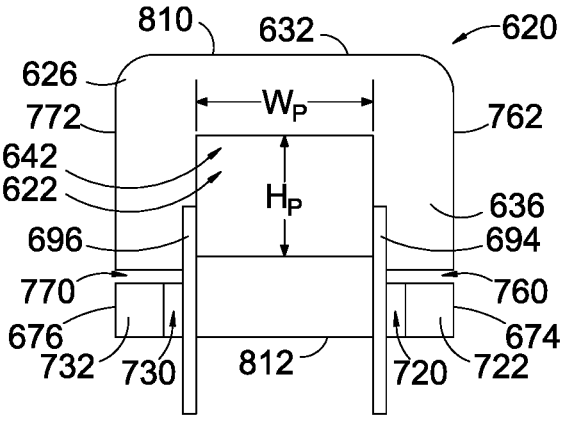
FIG. 13B illustrates a right side elevation view of the bobbin of FIG. 12 in accordance with the present disclosure; the view in FIG. 13B rotated 180 degrees about a vertical axis with respect to the view of FIG. 13A.
Figure 14:
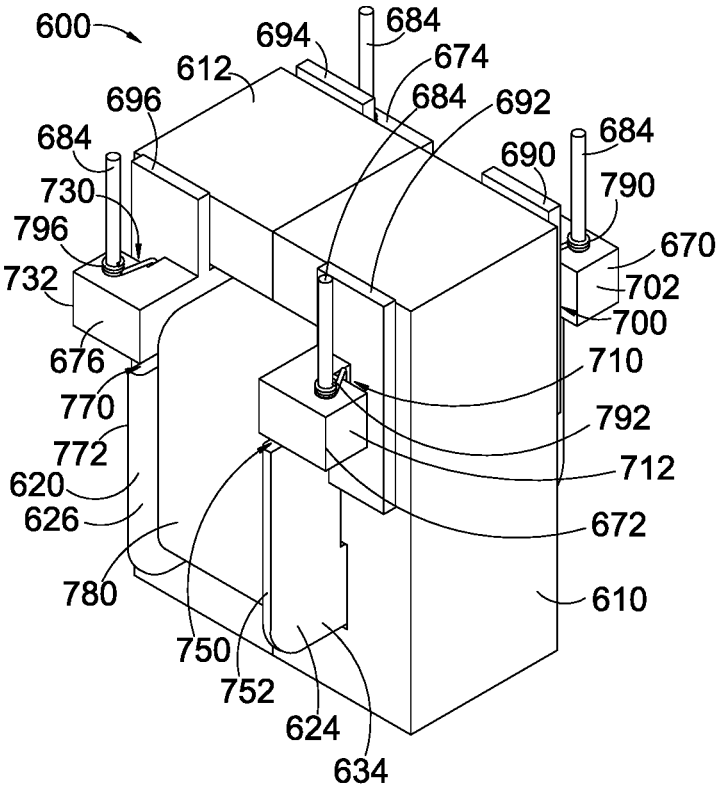
FIG. 14 illustrates a lower perspective view of the magnetic component of FIG. 10 in accordance with the present disclosure.

The bobbin includes a first pin support 670 that extends outwardly from a lower left corner of the outer surface 634 of the first outer flange 624 (where left and right are defined with respect to the exposed outer surface of the first outer flange). In other words, the first pin support is positioned adjacent to the first vertical plane on a side of the first vertical plane opposite the second vertical plane. A second pin support 672 extends outwardly from the lower right corner of the outer surface of the first outer flange. In other words, the second pin support is positioned adjacent to a side the second vertical plane opposite the first vertical plane. A third pin support 674 extends outwardly from the lower left corner of the outer surface 636 of the second outer flange 626 (where right is viewed from the inner surface of the second outer flange as shown in FIG. 10). In other words, the third pin support is positioned adjacent to a side the first vertical plane opposite the second vertical plane. A fourth pin support 676 extends outwardly from the lower left corner of the outer surface of the second outer flange as shown in FIGS. 12 and 14. In other words, the fourth pin support is positioned adjacent to a side the first vertical plane opposite the second vertical plane. Each pin support has a respective horizontal upper surface 680 and a respective horizontal lower surface 682. The respective horizontal upper surface 680 may also be referred to herein as a respective upper surface 680. The respective horizontal lower surface 682 may also be referred to herein as a respective lower surface 682. In the illustrated embodiment, each respective upper surface 680 of the first, second, third, and fourth pin supports is positioned below the first horizontal plane. The upper and lower surfaces of the pin supports are generally square and have a length (in a direction perpendicular to the flanges) of approximately 4.45 millimeters and have a width (in a direction parallel to the flanges) of approximately 4.45 millimeters. Each pin support has a height (thickness) of approximately 3.56 millimeters. Accordingly, each respective lower surface of the first, second, third, and fourth pin supports is coplanar. The coplanar lower surfaces of the first, second, third, and fourth pin supports define a second horizontal plane that is parallel with and positioned below the first horizontal plane. Each pin support retains a respective terminal pin 684. Each terminal pin extends vertically downward from the respective lower surface of the respective pin support.

The first pin support 670 is spaced apart from the passageway 622 by a first vertical shield 690, which extends from approximately 5.1 millimeters below the lower surface 682 of the first pin support to approximately 5.1 millimeters above the upper surface of the first pin support for a total height of approximately 13.72 millimeters, including the height of the first pin support. The first vertical shield 690 may also be referred to herein as a first wall 690. The first vertical shield 690 is positioned between the first pin support 670 and the first vertical plane. In similar manner, the second pin support 672 is spaced apart from the passageway by a second vertical shield 692. The second vertical shield 692 may also be referred to herein as a second wall 692. The second vertical shield 692 is positioned between the second pin support 672 and the second vertical plane. The third pin support 674 is spaced apart from the passageway by a third vertical shield 694. The third vertical shield 694 may also be referred to herein as a third wall 694. The third vertical shield 694 is positioned between the third pin support 674 and the first vertical plane. The fourth pin support 676 is spaced apart from the passageway by a fourth vertical shield 696. The fourth vertical shield 696 may also be referred to herein as a first wall 696. The fourth vertical shield 696 is positioned between the fourth pin support 676 and the second vertical plane.

Each of the first, second, third, and fourth vertical shields 690, 692, 694, 696 has a respective upper portion that extends above the respective upper surface 680 of each of the first, second, third, and fourth pin supports 670, 672, 674, 676. Each of the first, second, third, and fourth vertical shields 690, 692, 694, 696 further has a respective lower portion that extends below the respective lower surface 682 of each of the first, second, third, and fourth pin supports 670, 672, 674, 676. As mentioned above, each of the respective upper and lower portions of each vertical shield extends approximately 5.1 millimeters above or below the upper and lower surfaces of each respective pin support. Each lower portion of the first and second vertical shields 690, 692 extends below the outer periphery 630 of the first outer flange 624 by at least a first distance D1. Each lower portion of the third and fourth vertical shields 694, 696 extends below an outer periphery 632 of the second outer flange 626 by the first distance D1. The lower portions of each of the first, second, third, and fourth vertical shields 690, 692, 694, 696 are configured to support the bobbin 620 when installed on the PCB 614.

The first pin support 670 includes a first vertical slot 700 formed through the first pin support from the upper surface 680 to the lower surface 682. The first vertical slot 700 may also be referred to herein as a first pin support slot 700. In the illustrated embodiment, the first vertical slot is positioned adjacent to the first vertical shield 690 and has a width of approximately 1.27 millimeters horizontally from the first vertical shield. The first vertical slot has a length extending inwardly from a front outer surface 702 of the first pin support toward the first outer flange 624. In the illustrated embodiment, the length of the first vertical slot is approximately 2.54 millimeters such that the vertical slot does not extend to the first outer flange.

The second pin support 672 includes a second vertical slot 710 formed through the second pin support from the upper surface 680 to the lower surface 682. The second vertical slot 710 may also be referred to herein as a second pin support slot 710. In the illustrated embodiment, the second vertical slot is positioned adjacent to the second vertical shield 692. The second vertical slot has a length extending inwardly from a front outer surface 712 of the second pin support toward the first outer flange 624. In the illustrated embodiment, the width and length of the second vertical slot has a width and a length corresponding to the width and the length of the first vertical slot 700.

The third pin support 674 includes a third vertical slot 720 formed through the third pin support from the upper surface 680 to the lower surface 682. The third vertical slot 720 may also be referred to herein as a third pin support slot 720. In the illustrated embodiment, the third vertical slot is positioned adjacent to the third vertical shield 694. The third vertical slot has a length extending inwardly from a front outer surface 722 of the third pin support toward the second outer flange 626. In the illustrated embodiment, the width and length of the third vertical slot has a width and a length corresponding to the width and the length of the first vertical slot 700.

The fourth pin support 676 includes a fourth vertical slot 730 formed through the fourth pin support from the upper surface 680 to the lower surface 682. The fourth vertical slot 730 may also be referred to herein as a fourth pin support slot 730. In the illustrated embodiment, the fourth vertical slot is positioned adjacent to the fourth vertical shield 696. The fourth vertical slot has a length extending inwardly from a front outer surface 732 of the fourth pin support toward the second outer flange 626. In the illustrated embodiment, the width and length of the fourth vertical slot has a width and a length corresponding to the width and the length of the first vertical slot 700.

The first outer flange 624 includes a first horizontal slot 740, which is formed through the first outer flange immediately above the upper surface 680 of the first pin support 670. The first horizontal slot 740 may also be referred to herein as a first flange slot 740. In other embodiments (not shown), the first horizontal slot may be spaced apart from the upper surface of the first pin support. The first horizontal slot extends from a first outer edge 742 of the outer periphery 630 the first outer flange toward the first vertical shield 690. The first horizontal slot has a width corresponding to the width of the upper surface of the first pin support (e.g., approximately 4.45 millimeters in the illustrated embodiment). In other embodiments (not shown), the width of the first horizontal slot may be less than the width of the upper surface of the first pin support. In the illustrated embodiment, the first horizontal slot has a height vertically from the upper surface of the first pin support of approximately 0.89 millimeters.

The first outer flange 624 includes a second horizontal slot 750, which is formed through the first outer flange immediately above the upper surface 680 of the second pin support 672. The second horizontal slot 750 may also be referred to herein as a second flange slot 750. In other embodiments (not shown), the second horizontal slot may be spaced apart from the upper surface of the second pin support. The second horizontal slot extends from a second outer edge 752 of the outer periphery 630 of the first outer flange toward the second vertical shield 692. The second horizontal slot has a width corresponding to the width of the upper surface of the second pin support and has a height vertically from the upper surface of the second pin support. In the illustrated embodiment, the width and the height of the second horizontal slot correspond to the width and the height of the first horizontal slot 740. In other embodiments (not shown), the width of the second horizontal slot may be less than the width of the upper surface of the second pin support.

The second outer flange 626 includes a third horizontal slot 760, which is formed through the second outer flange immediately above the upper surface 680 of the third pin support 674. The third horizontal slot 760 may also be referred to herein as a third flange slot 760. In other embodiments (not shown), the third horizontal slot may be spaced apart from the upper surface of the third pin support. The third horizontal slot extends from a first outer edge 762 of the outer periphery 632 of the second outer flange toward the third vertical shield 694. The third horizontal slot has a width corresponding to the width of the upper surface of the third pin support and has a height vertically from the upper surface of the third pin support. In the illustrated embodiment, the width and the height of the third horizontal slot correspond to the width and the height of the first horizontal slot 740. In other embodiments (not shown), the width of the third horizontal slot may be less than the width of the upper surface of the third pin support.

The second outer flange 626 includes a fourth horizontal slot 770, which is formed through the second outer flange immediately above the upper surface 680 of the fourth pin support 676. The fourth horizontal slot 770 may also be referred to herein as a fourth flange slot 770. In other embodiments (not shown), the fourth horizontal slot may be spaced apart from the upper surface of the fourth pin support. The fourth horizontal slot extends from a second outer edge 772 of the outer periphery 632 of the second outer flange toward the fourth vertical shield 696. The fourth horizontal slot has a width corresponding to the width of the upper surface of the fourth pin support and has a height vertically from the upper surface of the fourth pin support. In the illustrated embodiment, the width and the height of the fourth horizontal slot correspond to the width and the height of the first horizontal slot 740. In other embodiments (not shown), the width of the fourth horizontal slot may be less than the width of the upper surface of the fourth pin support.

As discussed above, a respective terminal pin 684 extends vertically downwardly from the respective lower surface 682 of each pin support 670, 672, 674, 676. Each terminal pin is positioned to engage a respective cylindrical contact hole of the plurality of cylindrical contact holes 618 (shown in phantom) in the horizontally disposed PCB 614. At least two of the terminal pins are electrically connected to at least one coil 780, which is wrapped around the outer winding surface 628 that surrounds the horizontal passageway 622 of the bobbin 620. The at least one coil 780 may also be referred to herein as at least one winding 780. Multiple coils may be separated by one or more intermediate flanges (not shown) positioned between the first outer flange and the second outer flange.

In the illustrated embodiment, a first wire 790, a second wire 792, a third wire 794 and a fourth wire 796 extend from the coil (or coils) 780 to respective terminal pins 644. Each of the first, second, third, and fourth wires 790, 792, 794, 796 may also be referred to herein as first, second, third, and fourth end portions 790, 792, 794, 796. The first wire extends from the coil through the first horizontal slot 740 and through the first vertical slot 700 to the terminal pin extending from the first pin support 670. The second wire extends from the coil through the second horizontal slot 750 and through the second vertical slot 710 to the terminal pin extending from the second pin support 672. The third wire extends from the coil through the third horizontal slot 760 and through the third vertical slot 720 to the terminal pin extending from the third pin support 674. The fourth wire extends from the coil through the fourth horizontal slot 770 and through the fourth vertical slot 730 to the terminal pin extending from the fourth pin support 676.

When there is only one coil, the one coil only has the first wire 790 and the second wire 792. The first wire may extend through a first selected set of slots (first selected slot) to connect with an associated pin and the second wire may extend through a second selected set of slots (second selected slot) to connect with an associated pin. The first selected set of slots may be one of the first, second, third, or fourth pairs of horizontal and vertical slots. The second selected set of slots may be a different one of the first, second, third, or fourth pairs of horizontal and vertical slots. In certain embodiments (not shown), the bobbin 620 may include only the horizontal slots or the vertical slots. In other embodiments (not shown), the bobbin may not include any of the vertical or horizontal slots.

The E-core halves 610, 612 are positioned with the middle legs 160 of each E-core half positioned in the passageway 622. The middle leg 160 of the first E-core half is received by the first open end 640 of the passageway and the middle leg 160 of the second E-core half is received by the second open end 642. The width $W_P$ of the passageway accommodates the height C of the middle legs, and the height of the passageway accommodates the width H of the middle legs. In the vertical orientation, the height C may also be referred to therein in as a common width. The first vertical shield 690 and the second vertical shield 692 provide lateral support to the first E-core half. The first vertical shield electrically and mechanically isolates the first E-core half from the first wire 790. The second vertical shield electrically and mechanically isolates the first E-core half from the second wire 792. The third vertical shield 694 and the second vertical shield 696 provide lateral support to the second E-core half. The third vertical shield electrically and mechanically isolates the first second E-core half from the third wire 794. The fourth vertical shield electrically and mechanically isolates the second E-core half from the fourth wire 796.

As illustrated, the first outer leg 140 of the first E-core half is positioned above the passageway of the bobbin adjacent to an upper portion 800 of the outer periphery 630 of the first outer flange 624. The upper portion 800 of the outer periphery of the first outer flange may also be referred to herein as an upper peripheral portion 800. The second outer leg 150 of the first E-core half is positioned below the passageway of the bobbin adjacent to a lower portion 802 of the first outer flange. The lower portion 802 of the outer periphery of the first outer flange may also be referred to herein as a lower peripheral portion 802. As illustrated, the second outer leg 150 of the second E-core half is positioned above the passageway of the bobbin adjacent to an upper portion 810 of the outer periphery 632 of the second outer flange 626. The upper portion 810 of the outer periphery of the second outer flange may also be referred to herein as an upper peripheral portion 810. The first outer leg 140 of the second E-core half is positioned below the passageway of the bobbin adjacent to a lower portion 812 of the outer periphery of the second outer flange. The lower portion 812 of the outer periphery of the second outer flange may also be referred to herein as a lower peripheral portion 812. Because of the symmetry of the first and second outer legs of each E-core half, either or both of the first and second E-core halves 610, 612 may be rotated so that the either the first outer leg or the second outer leg is positioned above the passageway of the bobbin adjacent to the upper portion 800, 810 of the outer periphery 630, 632 of the first outer flange 624 or the second outer flange 626, respectively.

When assembled, the body portion 130 of the first E-core half 610 is positioned adjacent to the first outer flange between the first and second vertical shields. The body portion of the first E-core half extends above and below the upper and lower portions 800, 802, respectively of the outer periphery 630 of the first outer flange 624 by a second distance D2. The body portion 130 of the second E-core half 620 is positioned adjacent to the second outer flange between the third and fourth vertical shields. The body portion of the second E-core half extends above and below the upper and lower portions 810, 812, respectively of the outer periphery 632 of the second outer flange 626 by the second distance D2. The second distance D1 is less than the first distance D1. The second distance D2 is substantially equal to the width F of the first and second outer legs of the core halves. In the vertical orientation, the width F of the first and second outer legs of the core halves may also be referred to herein as a common height. This ensures that the magnetic component 600 is supported on the PCB 614 by the first, second, third, and fourth vertical shields 690, 692, 694, 696, rather than the E-core halves.

Each respective terminal pin 684 of the first, second, third, and fourth pin supports 670, 672, 674, 676 extends from the respective lower surface 682 by a third distance D3. The third distance D3 is greater than the first distance D1. This ensures that each respective terminal pin extends through a respective cylindrical contract hole 618 of the PCB 614 when the magnetic component 600 is installed on the PCB.

In the illustrated embodiment, the respective middle legs 160 of the two E-core halves 610, 612 are shorter than the respective first and second outer legs 140, 150 of the two E-core halves by the distance J/2. Thus, as shown in the cross-sectional views of FIGS. 13A and 13B, the end surfaces 162 of the middle legs are spaced apart from each other by a gap 820, which has a total gap length of J. In one embodiment, J may be approximately 0.1 millimeter.

In the embodiment of FIGS. 10-16, the magnetic component 600 in the edge configuration occupies a minimum horizontal surface area determined in part by the combined lengths B of outer legs 140, 150 of the two E-core halves 610, 612 and by the outer spacing of the pin supports 670, 672, 674, 676. For example, as shown in FIG. 13B, a minimum length WE of the magnetic component is the distance 2×B, which is approximately 21.08 millimeters in the illustrated embodiment. A minimum length $L_H$ of the magnetic component is the distance between the outer boundaries of the first pin support 670 and the second pin support 672 on opposite sides of the first outer flange 624. In one embodiment, the length $L_H$ is approximately 22.35 millimeters. Using the foregoing dimensions, the magnetic component of FIGS. 10-16 has a minimum area of approximately 471.14 square millimeters (approximately 0.73 square inches).

Figure 17:
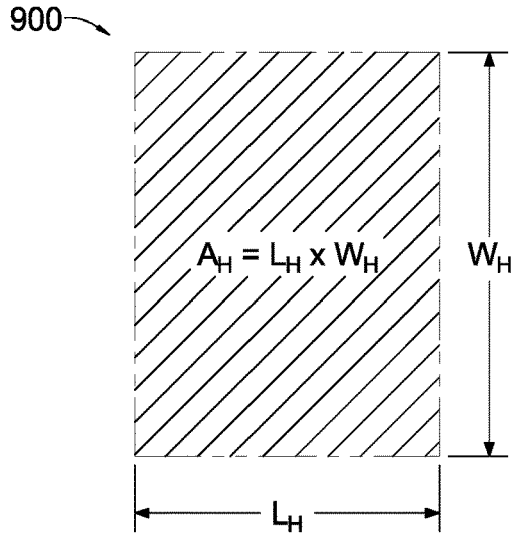
FIG. 17 illustrates a simplified top plan view of the surface area of a PCB occupied by the embodiment of FIGS. 2-5.
Figure 18:
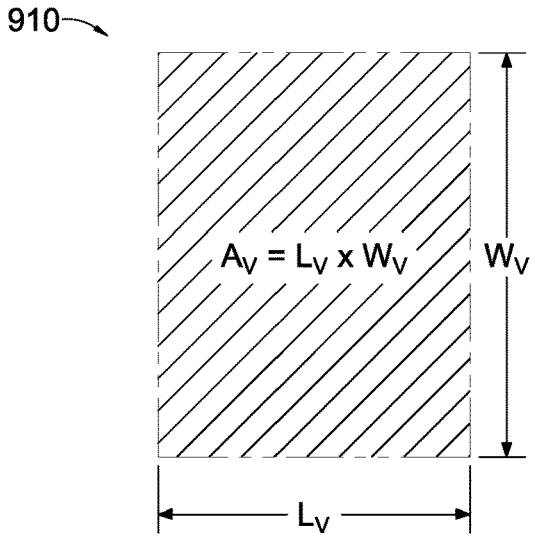
FIG. 18 illustrates a simplified top plan view of the surface area of a PCB occupied by the embodiment of FIGS. 6-9.
Figure 19:
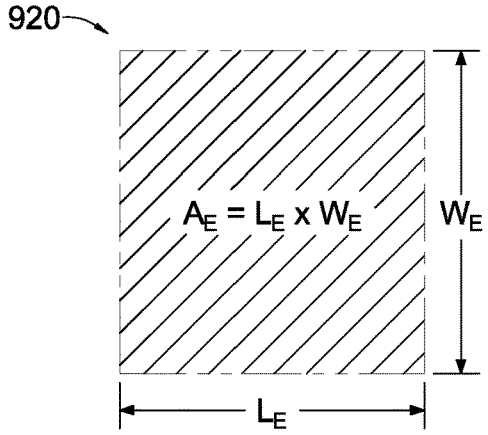
FIG. 19 illustrates a simplified top plan view of the surface area of a PCB occupied by the embodiment of FIGS. 10-16 in accordance with the present disclosure.

FIGS. 17, 18 and 19 illustrate a comparison of the surface areas occupied by the two known embodiments of FIGS. 2-5 and FIGS. 6-9 with respect to the reduced surface area occupied by the embodiment of FIGS. 10-16 in accordance with the present disclosure.

A first surface area 900 in FIG. 17 corresponds to the horizontal area occupied by the conventional horizontal embodiment of FIGS. 2-5, and, in particular corresponds to the dimensions of the plan view of FIG. 5. Using the dimensions discussed above, the first surface area 900 is approximately 588 square millimeters (588 $mm^2$) or approximately 0.91 square inches. For the conventional horizontal embodiment with the extended pin rails, the area is approximately 604 square millimeters or approximately 0.99 square inches.

A second surface area 910 in FIG. 18 corresponds to the horizontal area occupied by the embodiment of FIGS. 6-9, and, in particular corresponds to the dimensions of the plan view of FIG. 9. Using the dimensions discussed above, the second surface area 910 is approximately 605 square millimeters (605 $mm^2$) or approximately 0.98 square inches.

Figure 15:
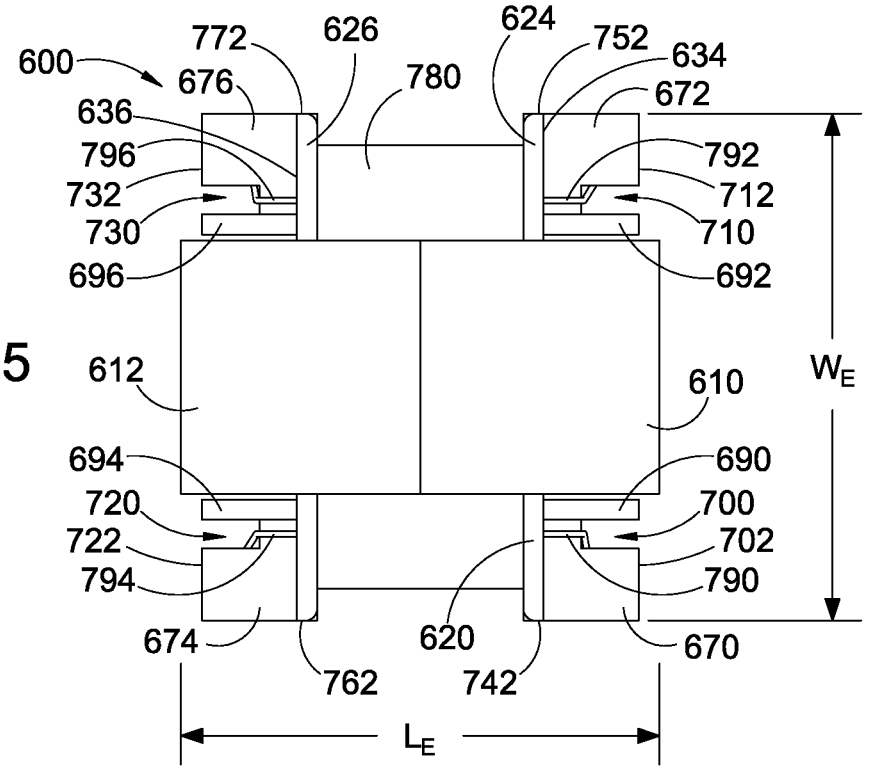
FIG. 15 illustrates a top plan view of the magnetic component of FIG. 10 in accordance with the present disclosure.
Figure 16:
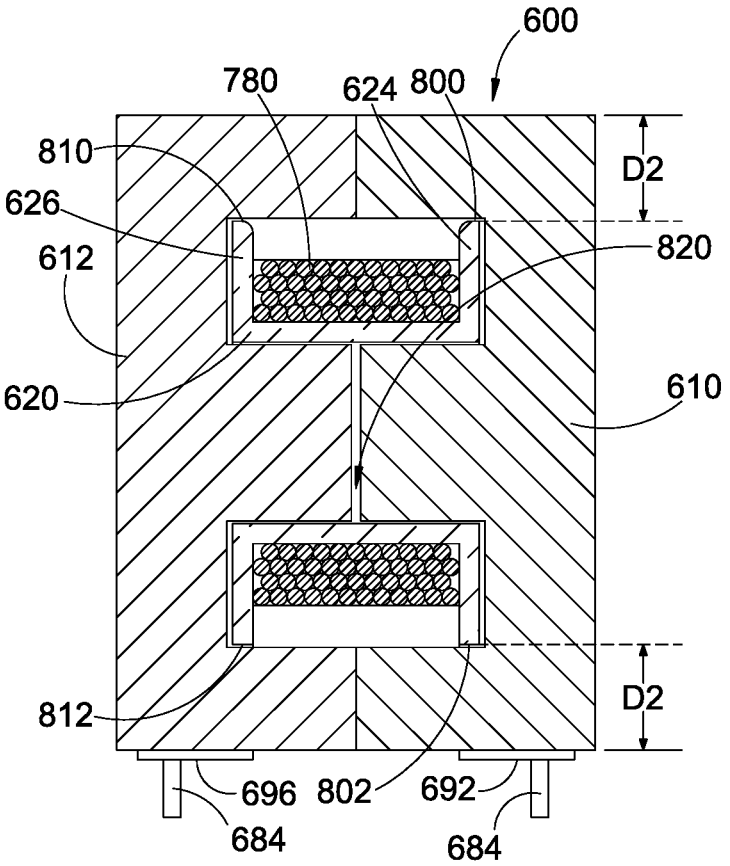
FIG. 16 illustrates a cross-sectional view of the magnetic component of FIG. 10 taken along line 16-16 of FIG. 10 in accordance with the present disclosure.

A third surface area 920 in FIG. 19 corresponds to the horizontal area occupied by the embodiment of FIGS. 10-16, and, in particular corresponds to the dimensions of the plan view of FIG. 15. Using the dimensions discussed above, the third surface area 920 is approximately 471 square millimeters (471 $mm^2$) or approximately 0.73 square inches.

The comparisons of the three surface areas 900, 910, 920 demonstrates that the embodiment in accordance with the present disclosure using the same E-core halves occupies approximately 80 percent of the surface area of the conventional horizontal embodiment illustrated in FIG. 5 and occupies approximately 78 percent of the horizontal embodiment with the extended pin rails. The embodiment in accordance with the present disclosure occupies approximately 78 percent of the surface area of the conventional vertical embodiment of FIG. 9. Accordingly, the embodiment in accordance with the present disclosure reduces the surface area by about 20 percent with respect to the conventional horizontal embodiment and reduces the surface area by about 22 percent with respect to the conventional vertical embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A magnetic component comprising:

a bobbin including:

a first end flange, a second end flange, and a passageway spanning between the first end flange and the second end flanges;

a first pin support, a second pin support, a third pin support, and a fourth pin support, the first and second pin supports extending from an outer surface of the first end flange and spaced apart by at least a width of the passageway, the third and fourth pin supports extending from an outer surface of the second end flange and spaced apart by at least the width of the passageway; and a first wall, a second wall, a third wall, and a fourth wall, the first and second walls extending perpendicularly from the outer surface of the first end flange and spaced apart by at least the width of the passageway, the first wall coupled to the first pin support and the second wall coupled to the second pin support, each of the first and second walls extending below an outer periphery of the first end flange by at least a first distance, the third and fourth walls extending perpendicularly from the outer surface of the second end flange and spaced apart by at least the width of the passageway, the third wall coupled to the third pin support and the fourth wall coupled to the fourth pin support, each of the third and fourth walls extending below an outer periphery of the second end flange by at least the first distance;

a first E-core half and a second E-core half, each of the first and second E-core halves having a body portion, a middle leg, a first outer leg, and a second outer leg, the body portion of the first E-core half positioned vertically and positioned adjacent to the outer surface of the first end flange between the first and second walls, the body portion of the first E-core half extending above and below the outer periphery of the first end flange by a second distance less than the first distance, the body portion of the second E-core half positioned vertically and positioned adjacent to the outer surface of the second end flange between the first and second walls, the body portion of the second E-core half extending above and below the outer periphery of the second end flange by the second distance, the middle leg of each of the first and second E-core halves extending into the passageway, the first outer leg of each of the first and second E-core halves positioned above the passageway of the bobbin adjacent to the outer periphery of the first end flange or second end flange, respectively, the second outer leg of each of the first and second E-core halves positioned below the passageway of the bobbin adjacent to the outer periphery of the first end flange or second end flange, respectively.

2. The magnetic component as defined in claim 1, wherein:

each of the first, second, third, and fourth pin supports includes a respective lower surface with a respective pin extending therefrom by a third distance, the third distance greater than the first distance.

3. The magnetic component as defined in claim 2, further comprising a winding wound around an outer surface of the bobbin surrounding the passageway between the first end flange and the second end flange, the winding having a first end portion and a second end portion, the first end portion of the winding connected to a first selected pin, the first selected pin being the respective pin of one of the first pin support, the second pin support, the third pin support, or the fourth pin support, the second end portion of the winding connected a second selected pin, the second selected pin being the respective pin of a different one of the first pin support, the second pin support, the third pin support, or the fourth pin support.

4. The magnetic component as defined in claim 3, wherein:

the first end portion of the winding is positioned through a respective flange slot and a respective pin support slot, the respective flange slot and the respective pin support slot each associated with the first selected pin; and the second end portion of the winding is positioned through a respective flange slot and a respective pin support slot, the respective flange slot and the respective pin support slot each associated with the second selected pin.

5. The magnetic component as defined in claim 1, wherein:

the body portion, the middle leg, the first outer leg, the second outer leg of the first and second E-core halves have a common thickness being substantially equal to the width of the passageway.

6. The magnetic component as defined in claim 1, wherein:

the first and second outer legs of the first and second E-core halves have a common width being substantially equal to the second distance.

7. A method for assembling a magnetic component, the method comprising:

providing a bobbin having a first outer flange, a second outer flange, and a passageway spanning between the first and second outer flanges, the passageway including a first passageway end open to the first outer flange and a second passageway end open to the second outer flange, the bobbin further including a first pin support, a second pin support, a third pin support, and a fourth pin support, each of the first and second pin supports extending from an outer surface of the first outer flange and spaced apart by at least a width of the passageway, each of the third and fourth pin supports extending from an outer surface of the second outer flange and spaced apart by at least the width of the passageway, each of the first, second, third, and fourth pin supports including a respective pin extending from a respective lower surface;

inserting a middle leg of a first E-core half into the first passageway end such that a body portion of the first E-core half is positioned vertically relative to the bobbin and first and second outer legs of the first E-core half are positioned above and below an outer periphery of the first outer flange, respectively; and inserting a middle leg of a second E-core half into the second passageway end such that a body portion of the second E-core half is positioned vertically relative to the bobbin and first and second outer legs of the second E-core half are positioned above and below an outer periphery of the second outer flange, respectively.

8. The method as defined in claim 7, further comprising:

wrapping a winding around an outer surface of the bobbin between the first outer flange and the second outer flange;

connecting a first end portion of the winding to a first selected pin, the first selected pin being the respective pin of one of the first pin support, the second pin support, the third pin support, or the fourth pin support; and connecting a second end portion of the winding to a second selected pin, the second selected pin being the respective pin of a different one of the first pin support, the second pin support, the third pin support, or the fourth pin support.

9. The method as defined in claim 8, further comprising:

routing the first end portion of the winding through a first respective flange slot and a first respective pin support slot, the first respective flange slot and the first respective pin support slot associated with the first selected pin; and routing the second end portion of the winding through a second respective flange slot and a second respective pin support slot, the second respective flange slot and the second respective pin support slot associated with the second selected pin.

* * * * *